US006651364B2

(12) United States Patent
Hermanson et al.

(10) Patent No.: US 6,651,364 B2
(45) Date of Patent: Nov. 25, 2003

(54) DISPLAY GLOBE HAVING EXTERNAL DYNAMIC ORNAMENTATION

(75) Inventors: Terry Hermanson, New York, NY (US); Meng-Suen Huang, Kowloon (HK)

(73) Assignee: Mr. Christmas Inc., New York, NY (US)

( * ) Notice: Subject to any disclaimer, the term of this patent is extended or adjusted under 35 U.S.C. 154(b) by 0 days.

(21) Appl. No.: 09/883,321

(22) Filed: Jun. 19, 2001

(65) Prior Publication Data

US 2002/0189142 A1 Dec. 19, 2002

(51) Int. Cl.[7] ..... G09F 19/00

(52) U.S. Cl. ..... 40/409; 40/411; 446/267; 434/131

(58) Field of Search ..... 40/426, 409, 411, 40/414, 415; 446/267, 176, 310, 236, 239, 242, 265, 330; 434/131, 134, 136

(56) References Cited

U.S. PATENT DOCUMENTS 962,069 A * 5/1910 Walters et al. ..... 446/267
1,167,020 A * 1/1916 Reuter ..... 40/426
1,453,755 A * 5/1923 Craver ..... 40/426
4,147,281 A * 4/1979 Missale et al. ..... 222/192
4,817,311 A * 4/1989 Ong ..... 40/406
5,092,065 A * 3/1992 Teng ..... 40/410
5,620,353 A * 4/1997 Lai ..... 40/410
6,299,451 B1 * 10/2001 Davila ..... 434/142

* cited by examiner

*Primary Examiner*—S. Joseph Morano
*Assistant Examiner*—Frantz F. Jules
(74) *Attorney, Agent, or Firm*—Fitzpatrick, Cella, Harper & Scinto

(57) ABSTRACT

A display globe assembly includes a transparent dome defining a cavity in which a scene is disposed and a base supporting the transparent dome. A shaft is rotatably disposed within the cavity of the dome and is rotated by a driving mechanism. An arm is attached to and projects generally radially from a distal end of the shaft within the cavity and engages an ornament disposed on exterior surface of the dome to move it thereon.

19 Claims, 7 Drawing Sheets

DISPLAY GLOBE HAVING EXTERNAL DYNAMIC ORNAMENTATION

FIELD OF THE INVENTION

This invention relates generally to a display globe, and more particularly to a display globe having moving external ornamentation.

BACKGROUND OF THE INVENTION

Display globes have been enjoyed by people for many years. Typically, the display globe includes a clear dome supported on a base, with a figurine or other display disposed within the dome. A water-tight seal between the base and the dome allows the interior of the display globe to be filled with water or other suitable liquid. Also sealed within the dome is particulate matter. When the display globe is shaken or otherwise agitated, the particulate matter becomes randomly and temporarily suspended in the liquid to simulate a snow scene or the like. Once the agitation has stopped, the particulate matter settles to the base of the display globe.

One example of such a conventional display globe is disclosed in U.S. Pat. No. 5,258,209. In that patent, a decorative display globe in the shape of a bell has figurines of a house, trees, and the like fixed to a base of the device. By grasping the handle of the display device and shaking it, the particulate matter becomes randomly and temporarily suspended in the liquid sealed in the decorative display to simulate a snow scene. Other conventional display globes provide a mechanical device, such as a driven agitator, for agitating the liquid to create and maintain the snow scene. One example of such a device is disclosed in U.S. Pat. No. 4,817,311.

Although conventional devices may be popular, there is always a demand for new and more entertaining products.

SUMMARY OF INVENTION

Accordingly, it is a principal object of the present invention to provide a display globe that includes entertaining features heretofore unknown.

One object of the present invention is to provide a display globe capable of moving an ornament on an exterior surface of a dome of the globe.

Another object of the present invention is to move an ornament on the exterior surface of the dome in different directions.

Yet another object of the present invention is to provide a driving mechanism within the display globe for moving the ornament on the exterior surface of the dome.

These and other objects are achieved by the present invention which, in one aspect, relates to a display including a transparent dome defining a cavity in which a scene is disposed, a driving mechanism that includes a shaft or pole rotatably disposed within the cavity of the transparent dome, and a driving arm connected at a first end to the shaft. The driving mechanism also includes a motor that rotates the shaft, and, in turn, the driving arm. That arm is adapted to slidably drive an ornament disposed on an exterior surface of the transparent dome to cause the ornament to ride on that exterior surface.

A base supports the transparent dome and the driving mechanism.

In another aspect of the invention, a magnet is secured to one end of the driving arm, the first end of which is secured to the shaft. The ornament disposed on the exterior surface of the dome, is equipped with a pad that is attracted to the magnet. Accordingly, when the driving arm is rotated by the shaft, the ornament is urged to move about the exterior of the dome.

In another aspect of the invention, the driving mechanism rotates the shaft in a single direction.

In another aspect of the invention, the driving mechanism oscillates the shaft in opposite directions.

In still another aspect of the invention, the driving mechanism includes the motor which drives a gear train that rotates the shaft. The motor and gear train are housed within the base of the display.

In another aspect of the invention, a device for moving an ornament on an exterior surface of a dome of a display globe includes a driving mechanism comprising a shaft or pole supported for rotation within the cavity of the dome and a driving arm secured at a first end to the distal end of the shaft and adapted to slidably move an ornament disposed on the exterior surface of the dome. The driving mechanism includes means for rotating the shaft.

In another aspect of the invention, a display includes a dome having an interior cavity in which a scene is disposed and having an exterior surface. Disposed within the dome are moving means for moving an ornament on the exterior surface of the dome.

In yet another aspect of the invention, the moving means comprises a shaft or pole and engaging means for engaging an ornament on the exterior surface of the dome. The shaft and the engagement means cooperate to move the ornament on the exterior of the dome.

These and other aspects, objects and features of the present invention will become apparent from the following detailed description of the preferred embodiments of the present invention, read in conjunction with the reference to the accompanying drawings.

DETAILED DESCRIPTION OF THE PREFERRED EMBODIMENTS

The invention relates generally to a display globe comprised of a transparent dome defining an interior cavity in which a scene, such as a Christmas scene, is disposed. In accordance with the invention, an ornament is controlled to slide or otherwise move along the outside or exterior surface of the dome by a driving mechanism disposed within the globe assembly.

Figure 1:
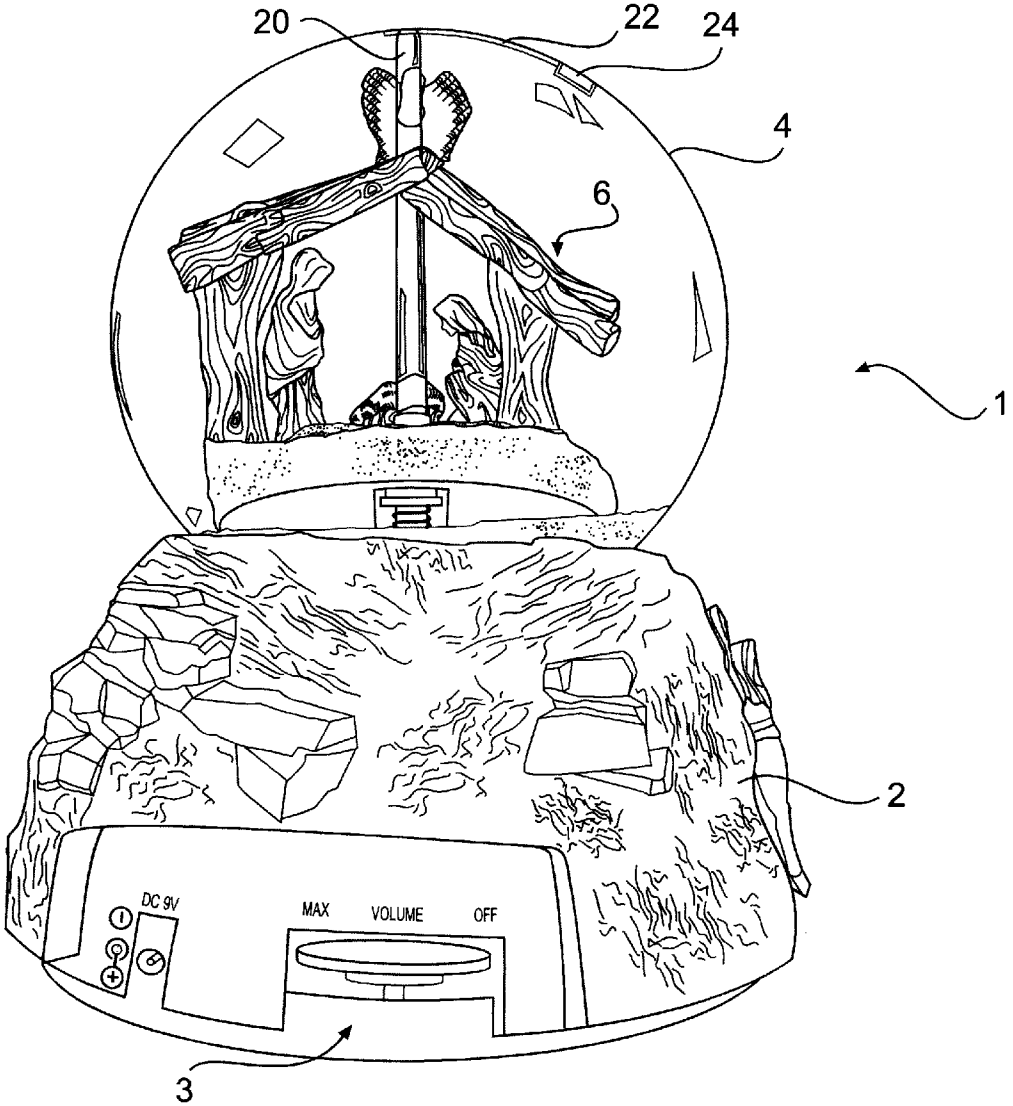
FIG. 1 is a perspective view of a display globe according to a first embodiment of the invention.

FIG. 1 depicts a display globe assembly, or simply display, 1 according to a first embodiment of the invention. In this embodiment, the display includes a base 2 supporting a dome 4, having a scene 6 disposed therein. In this nonlimiting example, the dome 4 is transparent and substantially spherical.

The base includes controls 3 for power to the display and for other functions, such as playing music, as is known in the art. As illustrated, a shaft or pole 20 extends through a center of the base 2, the dome 4 and the scene 6 to an inner surface at the top of the dome 4. A driving arm 22, which may be flexible, is secured at and projects generally radically away from one end of the top, or distal end, of the shaft 20. At its other end the arm 22 carries a driving element 24, such as a magnet. The shaft 20 and the driving arm 22 are preferably transparent.

Figure 2:
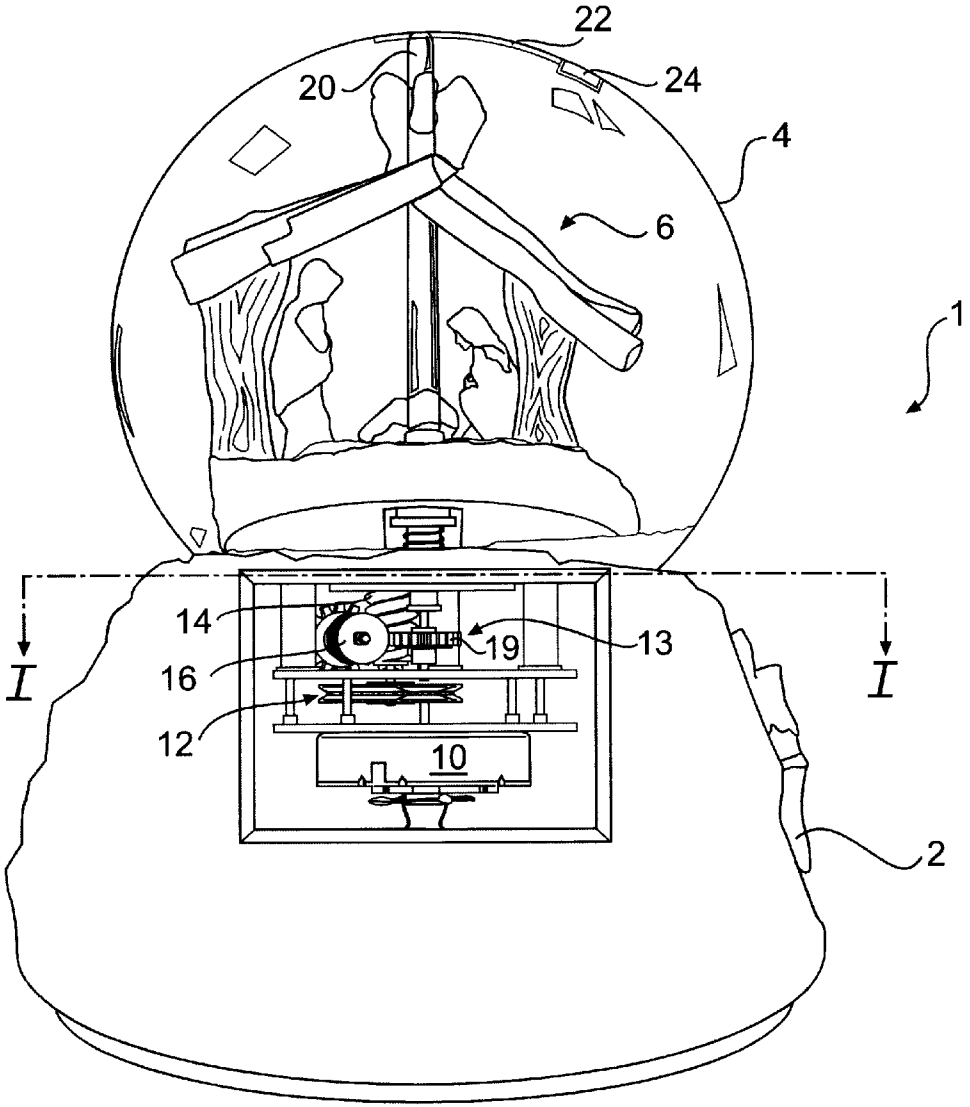
FIG. 2 is a perspective view of the display globe according to the first embodiment, incorporating an open view of the interior of the base.
Figure 3:
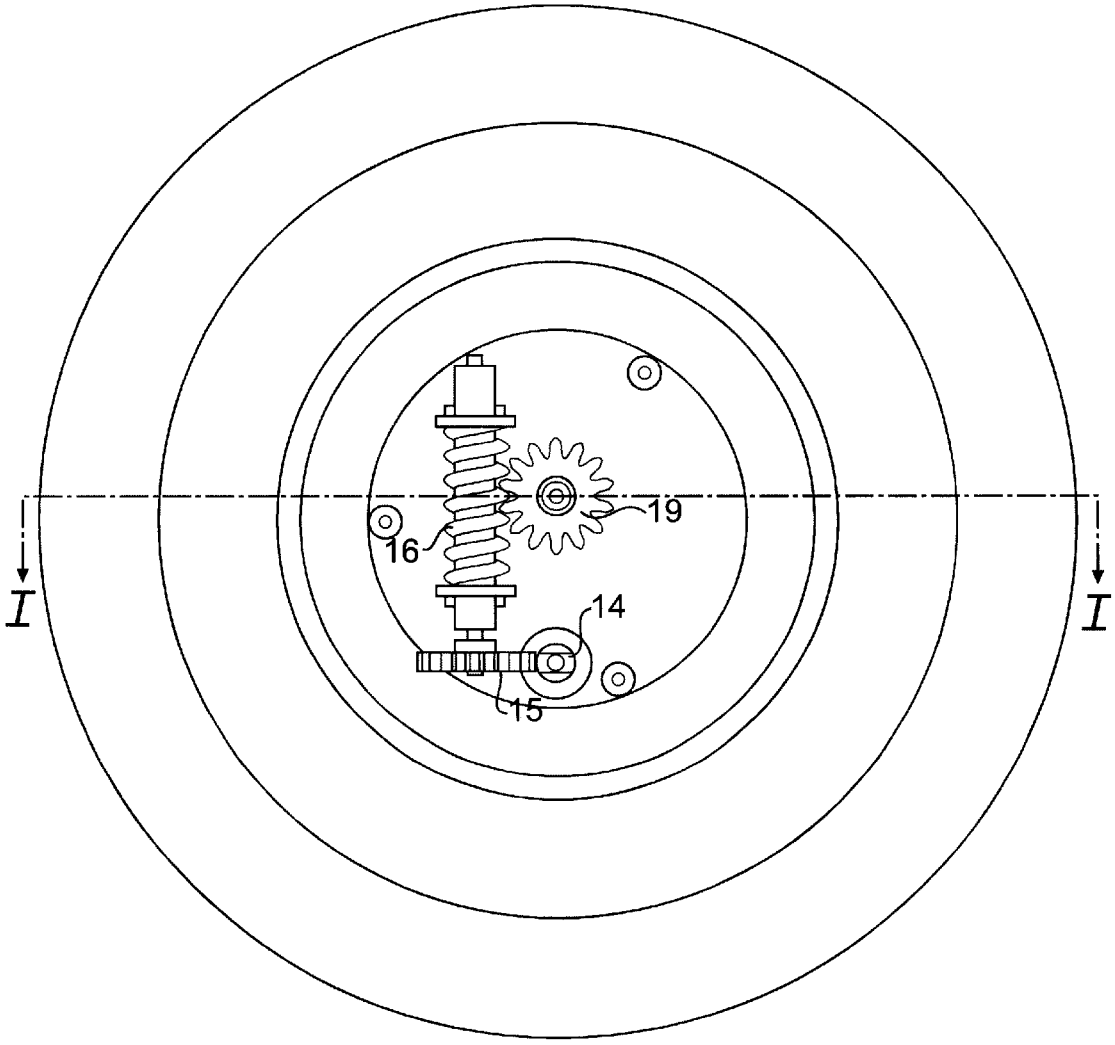
FIG. 3 is a cross-sectional view of the base, taken along the line I—I in FIG. 2.

FIG. 2 is a perspective view of the display 1 according to the first embodiment incorporating an open view of the interior of the base 2, showing generally the driving mechanism. This mechanism, as can also be seen in FIG. 3, includes a motor 10 that rotates a belt and pulley assembly 12, which in turn drives a gear train 13. The gear train 13 includes a vertical worm gear 14, a first driven gear 15, a horizontal worm gear 16 fixed and coaxial with gear 15, and a second driven gear 19 fixed to the shaft 20. The belt and pulley assembly 12, powered by the motor 10, rotates the vertical worm gear 14, thereby rotating the first driven gear 15, the horizontal worm gear 16 and the second driven gear 19, as best seen in FIG. 3. Because the second gear 19 is fixed to the shaft 20, when the motor 10 drives the belt and pulley system 12, the shaft 20 is rotated about its longitudinal axis. As the shaft 20 rotates, the driving arm 22 also rotates so that the magnet 24 traverses a circle about the axis of the shaft 20 on the interior surface of the dome.

As will be appreciated, alternative driving mechanisms for rotating the shaft 20 can be provided without departing from the scope of the invention.

Figure 4:
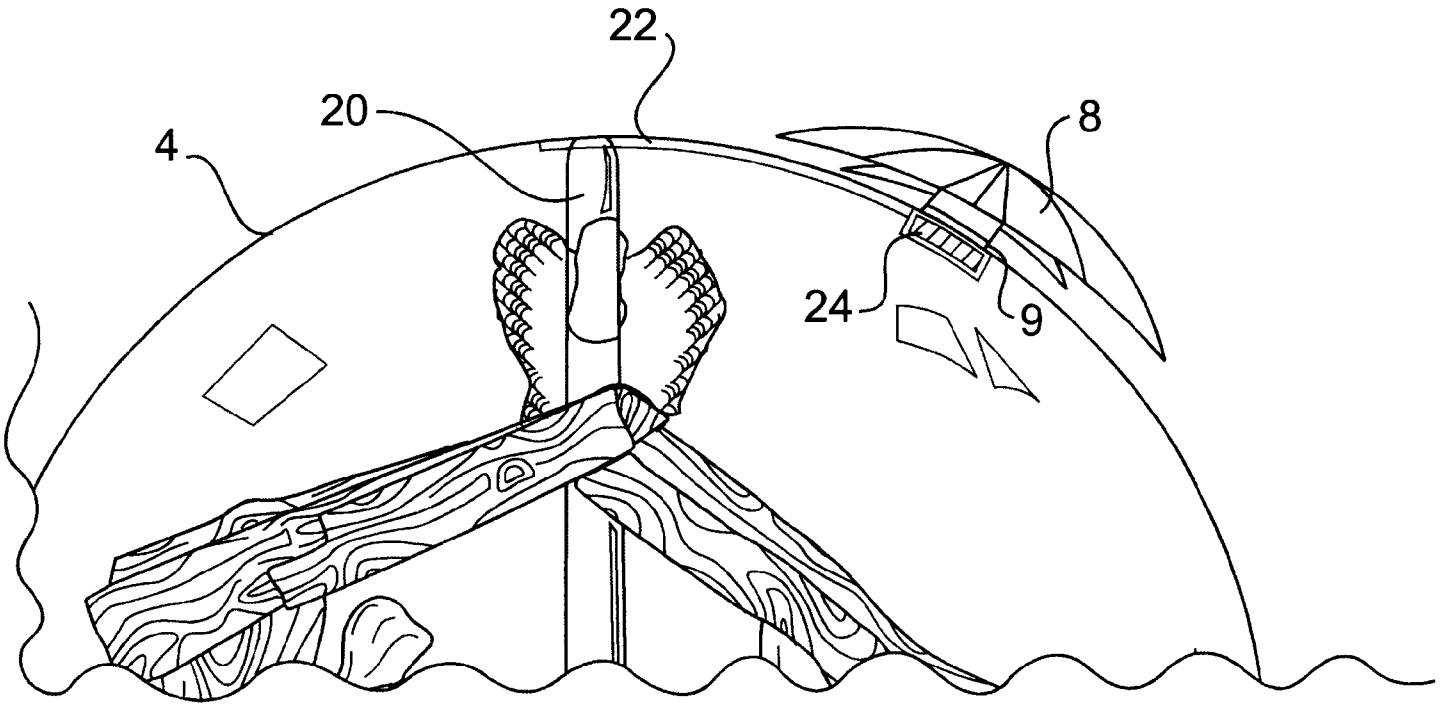
FIG. 4 is a perspective view of the top portion of the display globe according to the first embodiment.

As shown in FIG. 4, the magnet 24 can attract and hold an ornament 8 carried on the outside surface of the dome. In the first illustrated embodiment, the ornament is in the form of a star. Of course, it may take any other desired form. The ornament can incorporate a pad 9 of a ferrous metal that is attracted by the magnet 24. The pad may also have an antifriction surface made of, for example, polytetrafluoroethylene (TEFLON®) at its interface with the dome to facilitate sliding movement of the ornament on the outside of the dome.

Thus, as the magnet 24 traverses a circle on the inside surface of the dome 4, the ornament 8 traverses a circle on the outside of the dome 4.

Optionally, the vertical worm gear 14 may protrude through the bottom of the dome 4 and is attached to an agitator (not shown) that churns the simulated snow. In such a circumstance, the same motor 10 that powers the driving mechanism to rotate the ornament 8 can also drive the agitator to churn the simulated snow.

Figure 5:
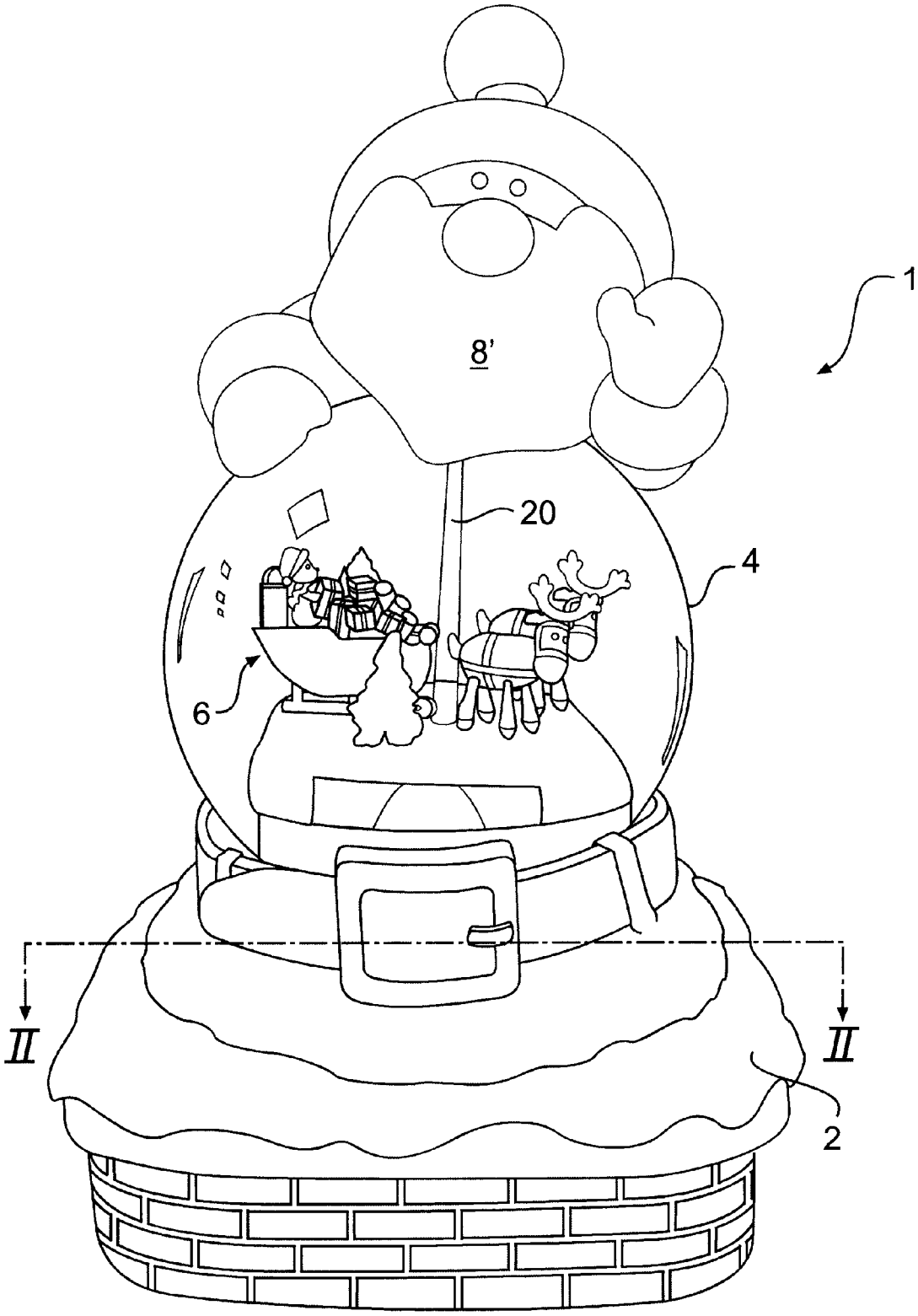
FIG. 5 is a perspective view of a display globe according to a second embodiment of the invention.

FIG. 5 illustrates a second embodiment of the invention. In this embodiment, the invention is substantially the same in its salient respects to the first embodiment, with the exception that the shaft 20 is driven in a different manner to create a different effect. In particular, the drive mechanism according to the second embodiment oscillates the shaft 20 reciprocally about its longitudinal axis. In this way, the ornament 8', in this illustrated example the arms and head of Santa Claus, can be moved to simulate a waiving motion.

Figure 6:
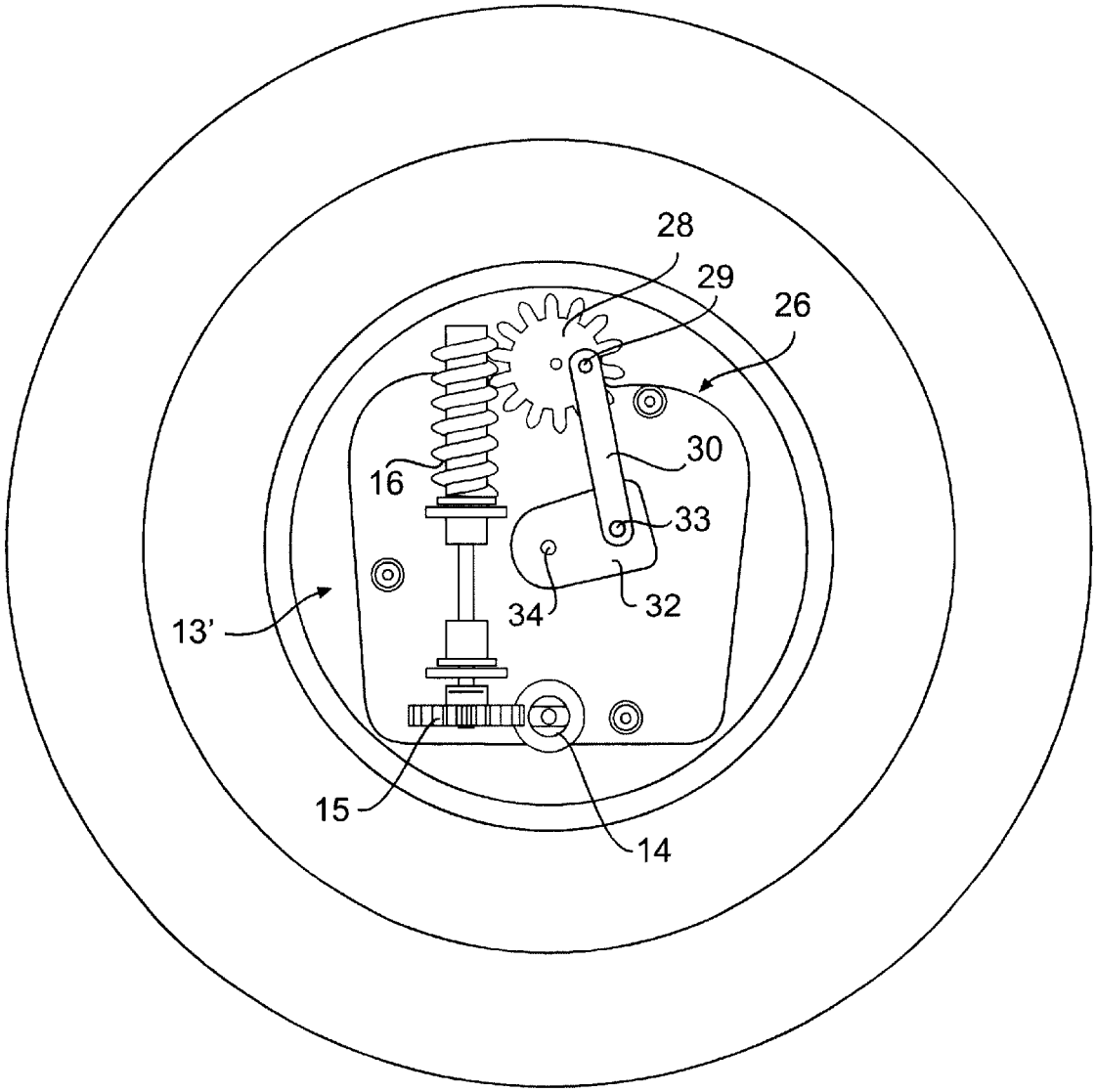
FIG. 6 is a cross-sectional view of a base of the display globe, taken along line II—II in FIG. 5.

More particularly, the drive mechanism of the second embodiment comprises a motor 10 driving a belt and pulley assembly 12, which in turn drives a gear train 13', shown in FIG. 6, having a vertical worm gear 14, a first driven gear 15 fixed coaxially to a horizontal worm gear 16 in the same manner shown and described above with respect to the first embodiment. As illustrated in FIG. 6, the vertical worm 14 drives the first driven gear 15 and, in turn, the horizontal worm 16.

Unlike the first embodiment, however, the drive mechanism of the second embodiment includes an oscillating assembly 26, comprised of a driven gear 28 having an off-center pin 29, a connecting rod or crank 30 and an oscillating arm 32 connected to the connected rod 30 by a floating pin 33. In operation, the horizontal worm 16 rotates the driven gear 28, and as the driven gear 28 rotates, the off-center pin 29 acts on connecting rod 30 to reciprocally pull and push the oscillating arm 32. As a result of the action by the off-center pin 29, the arm 32 oscillates about a pivot point 34. The oscillating arm 32 is fixed to the shaft 20 at the pivot point 34. Therefore, when the arm 32 oscillates, so does the shaft 20.

As in the first embodiment, alternative drive mechanisms can be used to oscillate the shaft 20 without departing from the scope of the invention.

Figure 7:
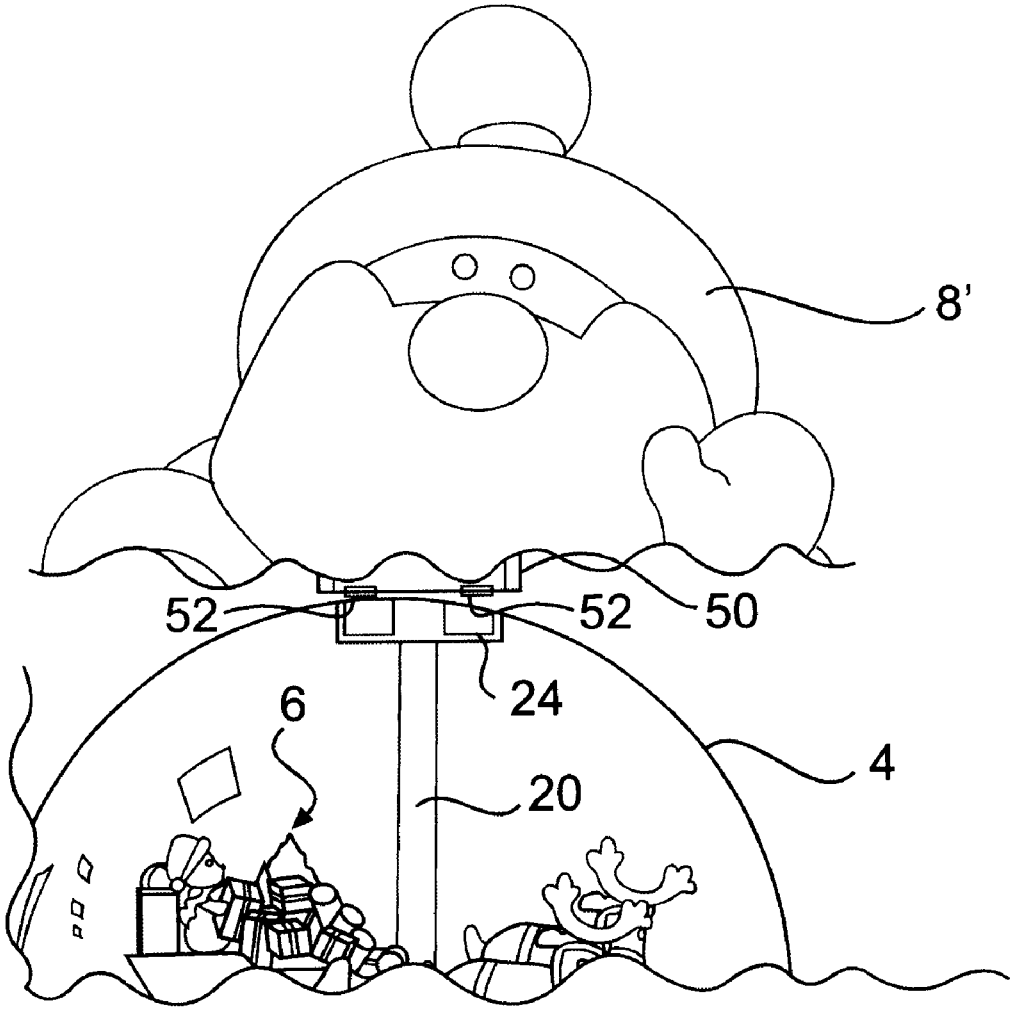
FIG. 7 is a perspective view of the top portion of the display globe according to the second embodiment, with a raised external ornament.

As shown in FIG. 7, a pair of magnets 24' is mounted on an arm 22' carried at the top or distal end of the shaft 20. The ornament 8' is formed with a socket 50 that incorporates two pads of ferrous metal 52 each of which is attracted to one of the magnets 24. Accordingly, when the shaft 20 and arm 22' are driven to oscillate, the ornament 8 carried on the exterior of the dome will also oscillate. By providing two magnets 24' on the arm 22' and two pads 52 in the ornament all remote from the axis of the shaft, a moment arm is created about that axis to facilitate the oscillatory movement.

Accordingly, two embodiments of the present invention have been disclosed in which attractive and different display movements are provided to exterior ornaments of a dome in a display globe assembly.

While the present invention has been described with respect to what is presently considered to be the preferred embodiments, the present invention is not limited to the disclosed embodiments. Rather, the present invention covers various modifications and equivalent arrangements included within the spirit and scope of the appended claims. The scope of the appended claims is to be accorded the broadest interpretation so as to encompass all such modifications and equivalent structures and functions.

What is claimed:

1. A display comprising:

a transparent dome defining a cavity in which a scene is disposed, and having an exterior surface;

a base supporting said transparent dome;

a shaft rotatably disposed within the cavity of said dome;

an ornament adapted to ride on the exterior surface of said dome;

an arm disposed on a distal end of said shaft within the cavity of said dome, said arm being adapted to slidably move said ornament disposed on the exterior surface of said dome;

a driving mechanism to rotate said shaft about its longitudinal axis; and a pad mounted with said ornament and made of a magnetically attracted material, wherein a magnetic force is provided between said arm and said ornament.

2. A display according to claim 1, further comprising a magnet carried at a location on said arm remote from said shaft.

3. A display according to claim 1, wherein said arm is flexible.

4. A display according to claim 1, wherein said driving mechanism includes a gear train housed within said base of said display, and wherein said gear train is adapted to rotate said shaft.

5. A display according to claim 4, wherein said gear train comprises a plurality of worm gears.

6. A display according to claim 1, wherein said driving mechanism is adapted to rotate said shaft in a single direction.

7. A display according to claim 1, wherein said driving mechanism is adapted to oscillate said shaft reciprocally.

8. A display according to claim 1, wherein said driving mechanism comprises a motor, and a gear train driven by said motor, said motor and said gear train being housed within said base of said display.

9. A device for moving an ornament on an exterior surface of a dome of a display assembly, the dome having a cavity; said device comprising:

an ornament adapted to ride on the exterior surface of the dome;

a shaft mounted for rotation within the cavity of said dome;

an arm disposed on a distal end of said shaft, adapted to slidably move said ornament disposed on the exterior surface of the dome;

a driving mechanism rotating said shaft; and a pad mounted with said ornament and made of a magnetically attracted material, wherein a magnetic force is provided between said arm and said ornament.

10. A device according to claim 9, further comprising a gear train and a motor for driving said gear train.

11. A device according to claim 10, wherein said gear train comprises a plurality of worm gears.

12. A device according to claim 9, wherein said driving mechanism is adapted to rotate said shaft in a single direction.

13. A device according to claim 9, wherein said driving mechanism is adapted to oscillate said shaft reciprocally.

14. A display according to claim 9, further comprising a magnet carried at a location on said arm remote from said shaft.

15. A display according to claim 14, further comprising a motor and a gear train driven by said motor.

16. A display comprising:

a dome having a cavity in which a scene is disposed and having an exterior surface;

an ornament adapted to ride on the exterior surface of said dome;

moving means for moving said ornament on the exterior of said dome, said moving means being at least partially disposed within said dome; and a pad mounted with said ornament and made of a magnetically attracted material, wherein a magnetic force is provided between said arm and said ornament.

17. A display according to claim 16, wherein said moving means comprises a shaft and engagement means for engaging said ornament on the exterior surface of said dome, wherein said shaft and said engagement means cooperate to slide said ornament along the exterior of said dome.

18. A display device comprising:

a dome defining an interior cavity, with said dome having an interior surface and an exterior surface;

a shaft mounted for rotation about its longitudinal axis within the cavity;

an arm attached to said shaft to project generally radially away therefrom;

a driving mechanism for rotating said shaft about its longitudinal axis and thereby rotating said arm;

an ornament adapted to ride on the exterior surface of said dome;

engagement means for engaging said arm and said ornament, thereby to cause said ornament to ride on the exterior surface of said dome when said arm is driven by said driving mechanism, wherein said engagement means comprises a magnet mounted on said arm at a location remote from said shaft; and a pad mounted with said ornament and made of a material attracted by said magnet.

19. A display device according to claim 18, further comprising an antifriction surface provided on said pad.

* * * * *